US005975995A

United States Patent [19]

Hykes et al.

[11] Patent Number: 5,975,995

[45] Date of Patent: Nov. 2, 1999

[54] MACHINING APPARATUS AND METHOD

[75] Inventors: Timothy William Hykes; Andrew Thomas Klouser, both of Greencastle, Pa.

[73] Assignee: Unova Ip Corp., Woodland Hills, Calif.

[21] Appl. No.: 08/881,913

[22] Filed: Jun. 25, 1997

[51] Int. Cl.[6] ..... B24B 1/00

[52] U.S. Cl. ..... 451/62; 451/251; 451/10

[58] Field of Search ..... 451/9, 10, 11, 451/49, 62, 242, 246, 249, 251, 399

[56] References Cited

U.S. PATENT DOCUMENTS

| | | | |
|---|---|---|---|
| 2,270,206 | 1/1942 | Flygare et al. | 451/249 |
| 2,287,449 | 6/1942 | Price | 451/251 |
| 3,271,910 | 9/1966 | Haisch | 451/249 |
| 4,423,990 | 1/1984 | Kodama et al. | 451/249 |
| 4,790,698 | 12/1988 | Heffron | 451/249 |
| 5,392,566 | 2/1995 | Wedeniwski | 451/251 |

FOREIGN PATENT DOCUMENTS

| | | | |
|---|---|---|---|
| 2073069 | 3/1981 | United Kingdom | 451/62 |

*Primary Examiner*—Eileen P. Morgan
*Attorney, Agent, or Firm*—Morris I. Pollack

[57] ABSTRACT

A pair of grinding wheel carriages, each carrying its own grinding wheel, are both carried by a grinding machine to one side of a work carriage and workpiece when carried thereby. The workpiece is, in this instance, a camshaft with multiple pairs of similar cams disposed along the axis of the workpiece. The operation control and disposition of the grinding wheels provides for use of either grinding wheel to grind cam pairs or both grinding wheels to simultaneously grind a pair of cam pairs. The method involves first grinding a first cam pair of spaced but in phase cams with one of the grinding wheels; thereafter utilizing both grinding wheels simultaneously to grind two pairs of spaced cam pairs and repeating this step depending upon the number of cam pairs, lastly the final pair of cam pairs is ground utilizing the other grinding wheel. Workspeed for the camshaft is varied depending upon the cam region being ground and to accommodate grinding two cam pairs where the phase angle of one cam pair differs from the phase angle of the other cam pair.

29 Claims, 3 Drawing Sheets

MACHINING APPARATUS AND METHOD

BACKGROUND OF THE INVENTION—FIELD OF APPLICATION

This invention relates to machining apparatus and systems and methods of machining workpieces; and, more particularly, to apparatus and methods of grinding cam lobes on a cam shaft.

BACKGROUND OF THE INVENTION—DESCRIPTION OF THE PRIOR ART

The machining of workpieces, such as the grinding of cam lobes on a cam shaft, more often then not, requires not only striving to minimize the cycle time to accomplish the machining but also striving to accomplish that machining so that the resultant parts conform to specifications of size and finish. The grinding of the various cam lobes on a cam shaft, for example, must generally be accomplished so that each cam lobe is ground to specified configuration, phase angle, and finish and with extremely tight tolerances. The exactitude to which the cam lobes are ground significantly affects the operation and efficiency of the engine utilizing the cam shaft.

The automotive industry, moreover, not only requires accurately ground and finished cam lobes but also such be accomplished in the least time possible. Efforts to create apparatus and methods to satisfy the automotive industry requirements of cam lobe grinding to tight specifications, tolerances and finishes with minimum cycle time have been extensive.

U.S. Pat. No. 4,885,874 to H. J. Wedeniwski for "Method Of Grinding Two Or More Cams Of a Camshaft" and U.S. Pat. No. 5,251,405 to S. Clauss, et al. for "Method For Circumferential Grinding Of Radially Non-Circular Workpieces" are examples of apparatus and methods seeking to provide accurately ground cam lobes on cam shafts. However, such apparatus is only capable of grinding one cam at a time thus resulting in what would be an unacceptable and relatively long cycle time for grinding an entire cam shaft.

Some cam lob grinding apparatus, such as shown and described in U.S. Pat. No. 1,843,301 to S. Player, et al. for "Cam Lapping Machine", seek to obtain a better cam lobe surface finish by alternating the direction the cam shaft is rotated while being machined. Other apparatus, such as shown and described in U.S. Pat. No. 4,197,679 to T. Yamada, et al. for "Method For Controlling The Rotational Speed Of A Rotary Body"; U.S. Pat. No. 4,443,976 to R. E. Kaiser, Jr. for "Cylindrical Grinding Machine"; U.S. Pat. No. 4,621,463 to Y. Komatsu, et al. for "Method Of Grinding Cams On A Camshaft" and in British Patent 1,596,635 to J. D. Parnum, et al. for "Cam Machining" seek to obtain quality cam lobe grinding and finishing by varying the work speed of the cam shaft while each cam lobe is being ground; while D. Cutchall, Jr. describes various approaches in developing variable work speeds in his Technical Paper titled "Optimization of the Cam Grinding Process" (Society of Manufacturing Engineers, 1990). Varying the work speed of the cam shaft while each of its cam lobes are being ground may provide for more accurately ground cam lobes but still presents the manufacturer with what might be an unacceptable cycle time for grinding all the cam lobes on the cam shafts.

U.S. Pat. No. 5,355,633 to T. Ishikawa, et al. for "Method Of Grinding A Workpiece Having Plural Cylindrical Portions with Plural Grinding Wheels" shows and describes multiple grinding wheels for grinding multiple journals simultaneously on a journal shaft. U.S. Pat. Nos. 4,175,358 to I. Bischeri for "Plunger-Grinder Especially for Grinding The Cams of Engine Timing Shafts"; U.S. Pat. No. 4,833,834 to H. B. Patterson, et al. for "Camshaft Belt Grinder" and U.S. Pat. No. 4,945,683 to J. D. Phillips for "Abrasive Belt Grinding Machine" all show multiple abrasive belts for simultaneously grinding cam lobes on a cam shaft. Such multiple tool simultaneous machining of multiple element workpieces appears to be a step in the correct direction for presumably reducing cycle time for machining of multiple elements carried by a single carrier (or shaft). None of these patent, though, show, describe or otherwise suggest combining simultaneous machining of parts with control over work speed of a shaft carrying the multiple parts; thus again, possibly sacrificing quality and performance for cycle time.

Gunter Zollig in U.S. Pat. No. 5,472,368 for "Method Of And Machine For Grinding Cams" seeks to combine multiple belts for grinding multiple cams with some variable control of the work speed (i.e. speed of rotation of the cam shaft). The Zollig structure, however, requires a belt or wheel for each set of cam lobes of a composite cam. As such, the belts or wheels must each be at least as wide as the two cam lobes and the space therebetween of each such composite cam and will exhibit uneven wear because the belts (wheels) will be worn where they engage and grind the cam lobe surfaces but will not exhibit wear along surfaces that do not engage and grind cam lobe surfaces. In addition, grinding belts have been displaying considerably more down time then grinding wheels and when the down time is averaged into the cycle work time the number of parts produced per unit time may prove to be unacceptable.

What's more is that while Zollig alludes to utilizing grinding wheels as well as belts the possibility of so positioning and controlling multiple wheels, each to be independently moved towards and away from its cam surface for grinding purposes, may not be economically or physically possible.

M. Katou in Japanese patent 59-232760 for "Grinding Method Of Cam For Internal-Combustion Engine" provides grinding wheels for grinding spaced cam lobes of splitted cams but does so with a single wheel and wheelhead constructed in one instance to grind a pair of cam lobes spaced apart by a single cam lobe disposed therebetween or by a pair of cam lobes disposed therebetween. There again this construction might prove unacceptable because it lacks workspeed controls and because it may well result in poor cycle time.

Utilizing two wheelheads each capable of movement towards and away from the work to be ground as well as in directions parallel to the axis of rotation of the work to be ground is schematically illustrated and sparsely described in an anonymously authored "Research Disclosure" of December 1986. The wheelheads each only carry a single grinding surface and no provision is made for workspeed control.

The prior art thus fails to provide a combination of components which act together to both minimize work cycle time while maximizing accuracy of work profile generation and quality of work finish.

SUMMARY OF THE INVENTION

It is therefore an object of this invention to provide new and novel machining devices.

It is another object of this invention to provide new and novel methods and processes for machining a workpiece.

It is yet another object of this invention to provide new and novel grinding devices.

It is yet still another object of this invention to provide new and novel cam lobe grinding apparatus.

It is yet a further object of this invention to provide new and novel methods and processes for grinding the cam lobes of camshafts.

It is yet a further object of this invention to provide new and novel apparatus for simultaneous grinding of multiple cam lobes while varying the speed of rotation thereof while being ground.

It is an additional object of this invention to simultaneously grind multiple cam lobes on a cam shaft wherein some of the cam lobes are to be out of phase with others of said cam lobes.

It is yet another additional object of this invention to simultaneously grind multiple cam lobes on a cam shaft wherein some of the cam lobes are to be out of phase with others of said cam lobes and wherein the cam shaft is to be rotated at variable speeds during cam lobe grinding.

In carrying out the invention there are provided a pair of wheelheads each disposed to be positioned and operated to independently grind a pair of cam lobes with both wheelheads disposed to be positioned and operated to be operated simultaneously to each simultaneously grind a pair of cam lobes wherein the cam lobes to be ground by the grinding wheel of one of the wheelheads are out of phase with the cam lobes to be ground by the grinding wheel of the other wheelhead. The cycle time for grinding all the cam lobes of a cam shaft is minimized by the process and method employed and the accuracy of the cam lobe profile and of the cam lobe finish are enhanced by controlling the rotational speed of a cam shaft for specified segments of the cam shaft.

Other object and features of the invention in its detail of construction and arrangement of parts will be seen form the above and from the following description of the preferred embodiments when considered with the drawing and from the appended claims.

DESCRIPTION OF THE PREFERRED EMBODIMENTS

Figure 1:
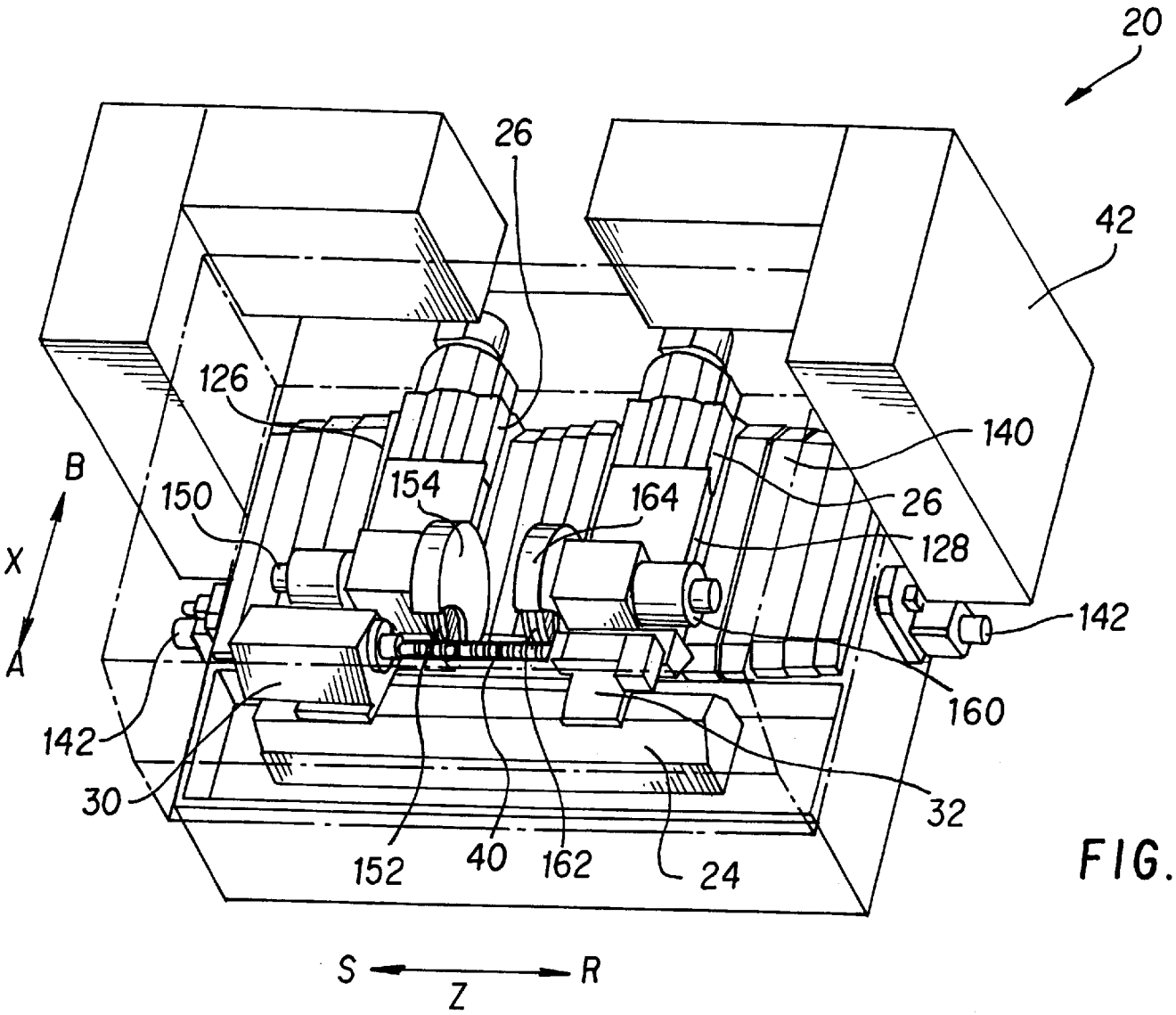
FIG. 1 is a schematic, in perspective, of a grinding machine utilizing workheads, wheelheads, and grinding wheels, incorporating the instant invention, for grinding articles of manufacture according to processes and methods also incorporating the instant invention.
Figure 2:
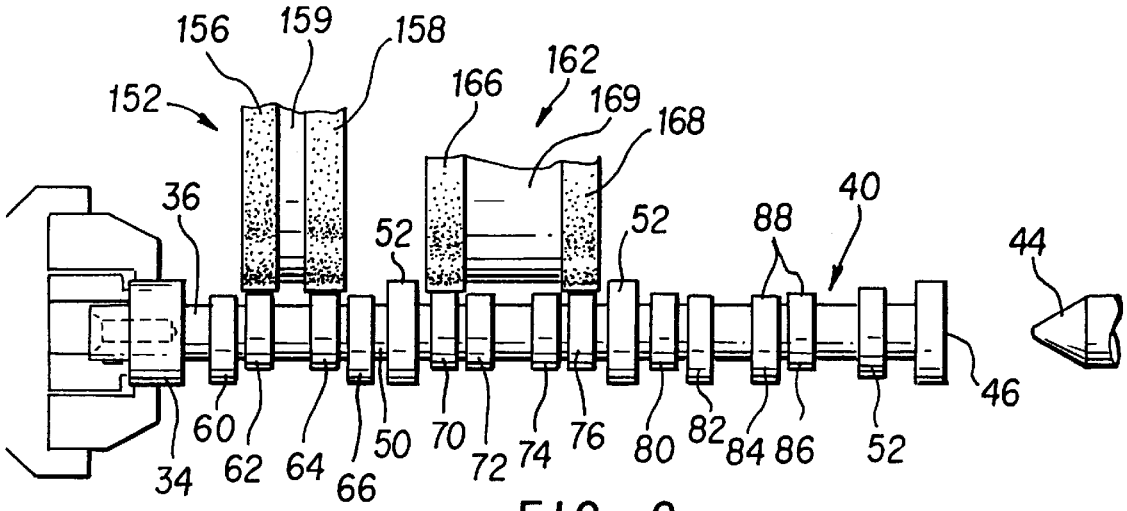
FIG. 2 is a schematic showing of a workpiece, in this instance a camshaft, carried between the headstock and tailstock of a workholder for grinding by the grinding machine of FIG. 1 according to the process of the instant invention.

With reference to FIG. 1 there is generally shown at 20 a grinding machine incorporating the instant invention and which includes a base 22 upon which is disposed a work carriage 24 of substantially conventional construction and a pair of tool or wheel carriages 26. Work carriage 24 mounts a workhead 30 and a tailstock 32, generally of conventional mounting, construction and operation and for relative movement towards and away from each other. Workhead 30 includes a clamping mechanism 34 for gripping a first end 36 of the workpiece which is, in this instance a camshaft 40. Clamping mechanism 34 is motorized by conventional mechanisms to effect rotation of clamped camshaft 40 under a control 42 (FIG. 1). Tailstock 32 may merely include a workcenter 44 (FIG. 2) that suitably seats in end 46 of camshaft 40 or ir may also include a driven clamping mechanism to drive the workpiece in synchronis with clamping mechanism 34.

Figure 3:
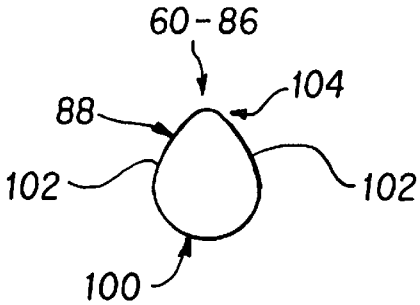
FIG. 3 is a schematic of a cam configuration showing, in particular, the regions thereof.
Figure 4:
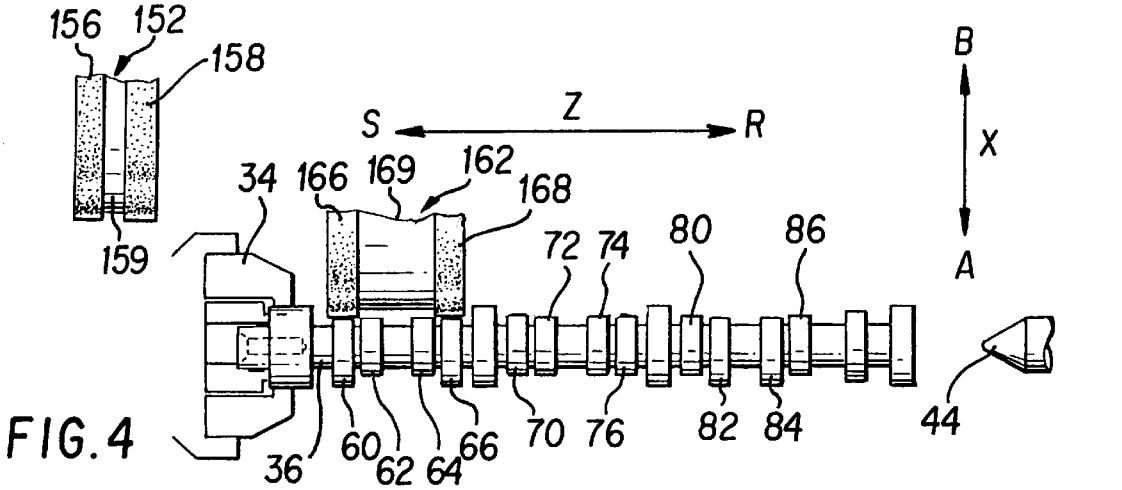
FIG. 4 is a schematic of a camshaft, similar to the camshaft of FIG. 2, slightly smaller and showing, in schematic, grinding wheels as they might be disposed in a first grinding operation for the camshaft.

Camshaft 40 includes a centrally disposed shaft 50 with a number of spaced journals or bearings 52 for mounting camshaft 40 within an engine. A plurality of cams 60–86 are disposed in spaced relationship along shaft 50; and are fixedly disposed with respect to shaft 50 so that there is no relative movement either rotatively of linearly between same. There are numerous possible configurations for the cam surface 88 of cams 60–86 depending on the intended use for the camshaft 40. Generally speaking, however, each such cam will include a basecircle region 100 (FIG. 3), a pair of flank regions 102, and a nose region 104. When cams 60–86 respectively are affixed to shaft 50 they are usually arranged with the respective nose regions positioned at different angular positions (I. e. out of phase) about the shaft 50 depending upon the expected coaction of nose region 104 of camshaft 104 with the valve lifter or other cam follower (now shown). In some camshaft arrangements some cams 50 may be arranged with their respective nose regions angularly aligned (i.e. In phase). Exact configuration of the cams and final disposition of their respective nose regions 104 and other regions is, in fact, accomplished when the cams are ground.

As shown in some of the prior art patents referred to above many camshafts have their cams ground one at a time thus requiring for each cam on the camshaft a cycle for the wheelhead including a plunge movement along the X axis (FIG. 1) in the direction of arrow A until the cam is ground to the desired configuration, a retractive movement along the X axis in the B direction and a movement of wheel carriage 26 along the Z axis in either the R or S direction to align the grinding wheel with the next cam to be ground. If there are twelve cams on the camshaft, as for camshaft 40, then the grinding machine must proceed through 12 plunges, retractions and alignments between the grinding wheel and cams to be so ground; resulting in a relatively long cycle time to grind the entire camshaft.

Others of the prior art patents discussed above grind all of the cams on a camshaft at the same time. However, it has been found that cams may be ground to better tolerances, specifications and finishes if different regions of the cams (i.e. base circle, flanks and nose) are ground at different speeds of revolution of the camshaft. Thus because the respective cams are disposed at different phases about the camshaft a single speed of revolution (workspeed) for the camshaft for which all the cams are being simultaneously ground comprimises the proper grinding and finishing of most if not all the cams on the shaft.

Tool or wheel carriages 26 each mount a wheelhead 126 (FIG. 1), 128 respectively; with each such wheelhead being capable of selective movement in the directions of arrows A and B along the X axis by a mechanism 140 and in the directions of arrows R and S along the Z axis by a mechanism 142, all under operation of control 42. Wheelhead 126 includes a wheelspindle 150 which mounts a grinding wheel 152 (FIGS. 1 and 2) within a cover guard 154 (FIG. 1); while wheelhead 128 includes a wheelspindle 160 which mounts a grinding wheel 162 (FIGS. 1 and 2) within a cover guard 164 (FIG. 1).

Grinding wheel 152 (FIGS. 2–7) is a unitary wheel with a pair of spaced grinding surfaces 156, 158 and a reduced diameter center section 159 therebetween. Grinding wheel 162 is also a unitary wheel with a pair of spaced grinding surfaces 166, 168 and a reduced diameter center section 169 therebetween.

Camshaft 40 includes six cams, 62, 64, 72, 74, 82 and 84 which are for intake purposes and for which cams 62,64 have the same phase angle, cams 72,74 have the same phase angle and cams 82, 84 have the same phase angle. Cams 60, 66, 70. 76, 80 and 86 of camshaft 40 are all selected and disposed for exhaust purposes with cams 60, 66 having the same phase angle, cams 70, 76 having the same phase angle and cams 80 and 86 having the same phase angle.

Grinding wheel 152 has its grinding surfaces 156, 158 spaced to coact with and grind intake cams 62, 64, 72, 74 and 82, 84. Grinding wheel 162 has its grinding surfaces spaced to coact with and grind exhaust cams 60, 66, 70, 76 and 80, 86. The respective grinding surfaces 156, 158, 166 and 168 are preferably CBN (Cubon boron nitride) but other suitable and conventional grinding substances may be utilized.

Wheelhead 126 is constructed and controlled to position its grinding wheel 152 from a position to the side and away from cam 60 to a position aligned with cams 82, 84; as well as aligned with cams 62, 64 and 72, 74 therebetween. Wheelhead 128 is similarly cconstructed and controlled to position its grinding wheel 162 from a position to the side and away from cam 86 to a position aligned with cams 60,66; as well as aligned with cams 70, 76 and 80 and 86 therebetween.

Figure 5:
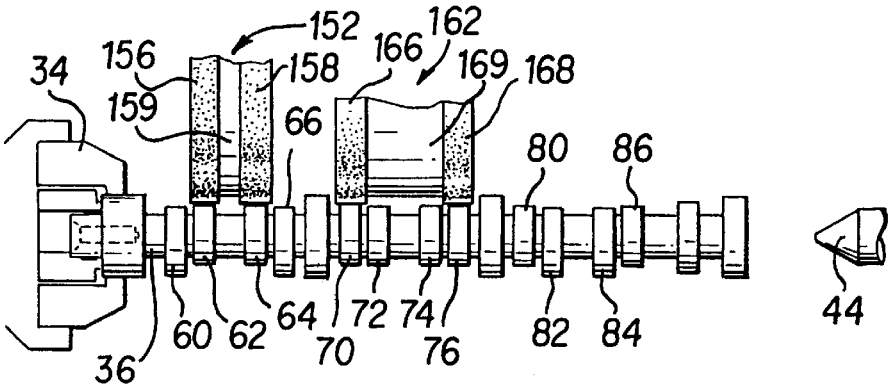
FIG. 5 is a schematic of the camshaft of FIG. 4 but showing the grinding wheels as they might be disposed in a second grind operation of the camshaft.

The method and process for grinding camshaft 40 is best described with reference to FIGS. 4 through 7. The grind parameters for the intended camshaft to be ground are provided for control 42 as well as other criteria to effect proper grinding and finishing of the camshaft. Camshaft 40 is positioned between workhead 30 and tailstock 32. Control 42 activates mechanism 142 to position grinding wheel 152 to the side (left) of cam 60 on camshaft 40 with sufficient space so that mechanism 142 for wheel 162 can align grinding surfaces 166, 168 thereof with cams 60, 66 respectively. Control 42 then operates mechanism 140 for wheel 162 to move wheel 162 towards and into surface contact with cams 60, 66 to grind same in accordance with prescribed grind parameters. Control 42 will also control the workspeed for camshaft 40 which is optimized for each region (base circle, flanks, and nose) of cams 60, 66 taking into consideration that cams 60, 66 are in phase one with the other. After sparkout wheel 162 is retracted (in the direction of arrow B along the X axis) and shifted (in the direction of arrow R along the Z axis) until its grinding surfaces 166, 168 are aligned with cams 70, 76 respectively (as shown in FIG. 5). Simultaneously with the movements of wheel 162 control 42 will effect movement of wheel 152 to align its grinding surfaces 156, 158 with cams 62, 64 (also as shown in FIG. 5). Thereafter control 42 will effect movement of both wheels 152, 162 along the X axis in the direction of arrow A, and thereafter each wheel 152, 162 in the directions of arrows A and B until wheel surfaces 156, 158 have ground cams 62, 64 respectively and wheel surfaces 166, 168 have ground cams 70, 76 respectively. The workspeed for camshaft 40 is established to accommodate the grind parameters for the regions of cams 62, 64 as well as for cams 70, 76 and takes into consideration that the phase angles for cams 62, 64 are the same but different from the phase angles for cams 70, 76. As such the workspeed for camshaft 40 when four cams (two like pairs) are being simultaneously ground comprises an accommodation between the optimal workspeed for one such pair and the optimal workspeed for the other such pair, further modified so as not to exceed the maximum permitted workspeed for any region for either pair of cams.

Figure 6:
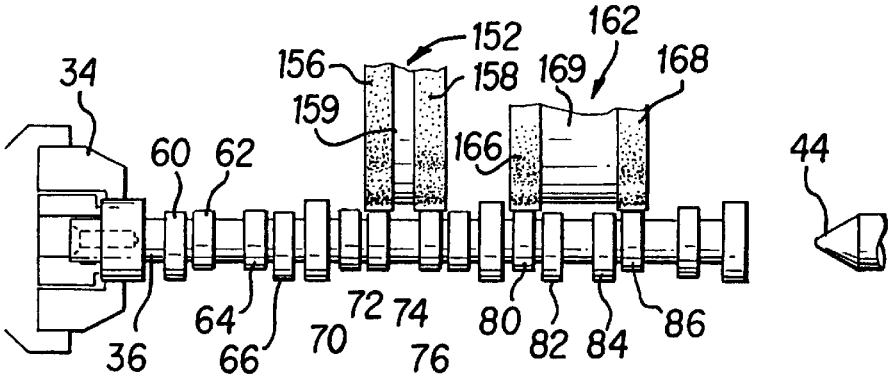
FIG. 6 is a schematic of the camshaft of FIGS. 4 and 5 but showing the grinding wheels as they might be disposed in a third grind operation for the camshaft.

After sparkout wheels 152, 162 are simultaneously retracted by control 42 and grinding surfaces 156, 158 of wheel 152 aligned with cams 72,74 while grind surfaces 166, 168 of wheel 162 are aligned with cams 80, 86 (FIG. 6). Control 42 thereafter effects a simultaneous plunge grind of cams 72, 74 and 80, 86 in a manner similar to the plunge grind for cams 62, 64, 70, 76 (FIG. 5). Workspeed control for camshaft 40 when grinding cams 72,74,80,86 would be controlled similarly to that described above for cams 62,64, 70,76 but take into consideration the specific parameters for cams 72,74,80,86 as well as the specific phase angle relationships therebetween.

When cams 72,74,80,86 have been ground wheels 152, 162 are again simultaneously retracted (along the X axis in the direction of arrow B) under operation of control 42 and wheel 162 is moved to the side (right) of camshaft 40 while grinding surfaces 156, 158 of grinding wheel 152 are aligned with cams 82, 84. Control 42 thereafter effects the required movements of wheel 152 to grind cams 82,84; and for the required workspeed for camshaft 40 taking into consideration that cams 82, 84 have identical phase angles. After sparkout wheel 152 is retracted and camshaft 40 can be removed from between headstock 30 and tailstock 32 and replaced by another camshaft 40 with cams to be ground.

The aforedescribed method and process significantly reduces the cycle time for grinding a camshaft while taking into consideration that the cam surfaces for the cams of such camshafts may be better ground by providing a variable workspeed for the camshaft that accomodates grinding parameters for different regions of the cams.

Figure 7:
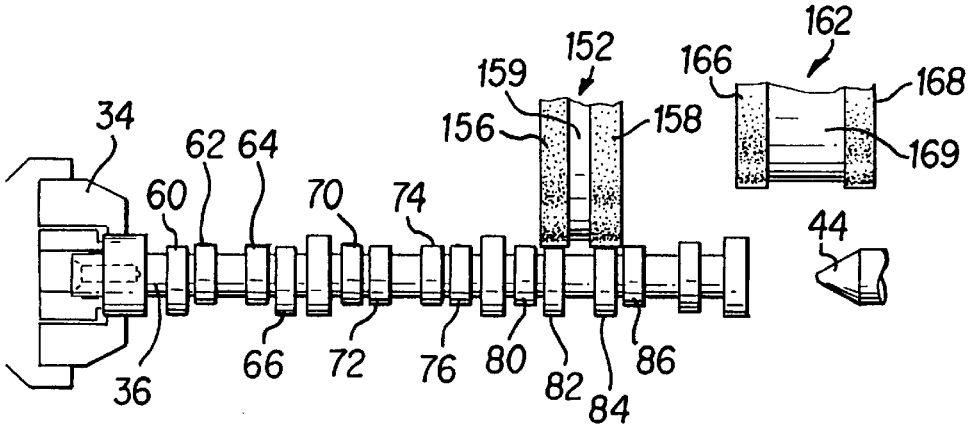
FIG. 7 is a schematic of the camshaft of FIGS. 4, 5, and 6 but showing the grinding wheels as they might be disposed in a fourth grind operation for the camshaft.

It is also possible to grind camshafts by reversing the order of grinding from that described above (i.e. proceeding from FIG. 4 to FIG. 7) to one starting as shown in FIG. 7 and proceeding therefrom through the steps shown and described for FIGS. 6, then 5, then 4. In addition to grinding cams of camshafts as shown and described the apparatus and methods of this invention may be utilized to grind the pins of crankshafts.

From the above description it will be seen that there has been provided a new and novel grinding machines and methods and processes for grinding.

It is understood that although there has been shown and described preferred embodiments of the invention that various modifications may be made in details thereof without departing from the spirit as comprehended by the following claims.

What is claimed is:

1. A grinding machine; comprising:

(a) base means for supporting machine components;

(b) workpiece support means for supporting and positioning a workpiece and for rotating the workpiece about a workpiece axis of rotation extending through the workpiece;

(c) first grinding means carried by said base means for coaction with a workpiece when, supported by said workpiece support means, to grind selected portions of the workpiece;

(d) second grinding means carried by said base means for coaction with a workpiece, when so carried by said workpiece support means, to grind other selected portions of the workpiece;

(e) wherein said first grinding means and said second grinding means are movable towards and away from each other in directions parallel to said workpiece axis of rotation; and (f) control means coacting with said first grinding means and said second grinding means to effect and control operation thereof and grinding of a workpiece, when supported by said workpiece support means, such that said first grinding means and said second grinding means may each individually grind different selected portions of a workpiece and such that said first grinding means and said second grinding means may simultaneously each grind and different selected portions of the workpiece.

2. The grinding machine of claim 1, wherein said first grinding means and said second grinding means are each positionable and controllable to grind portions of a workpiece from one end of the workpiece to the other end of the workpiece.

3. The grinding machine of claim 1, wherein said workpiece support means is also operable to rotate a workpiece, when supported thereby, according to workspeed parameters relating to surface regions of the workpiece when being ground and as effected by said control means.

4. The grinding machine of claim 3, wherein said workspeed parameters take into consideration grinding of different surface regions of different portions of a workpiece which are to be ground.

5. The grinding machine of claim 1, wherein said first grinding means and said second grinding means are both disposed on the same side of said base means with respect to said workpiece support means.

6. The grinding machine of claim 5, wherein said first grinding means mounts a first grinding wheel of a size and configuration to grind two spaced selection portions of a workpiece and said second grinding means mounts a second grinding wheel of a size and configuration to grind two spaced selected portions of a workpiece.

7. The grinding machine of claim 1, wherein the portions of the workpiece to be ground are cams and the workpiece is a camshaft.

8. The grinding machine of claim 2 wherein said first grinding means and said second grinding means are so positionable longitudinally along a wheel axes of rotation parallel to said workpiece axis of rotation.

9. The grinding machine of claim 8 wherein said first grinding means and said grinding means are so controllable to move towards and away from said workpiece axis of rotation.

10. A grinding machine; comprising:

(a) a grinding machine base;

(b) a workpiece support;

(c) a first grinding assembly carried by said base;

(d) a second grinding assembly carried by said base;

(e) wherein said first grinding means and said second grinding means are movable towards and away from each other in directions parallel to said workpiece axis of rotation; and (f) a grinding machine coacting with said first grinding assembly and said second grinding assembly to effect and control operation thereof and grinding of a workpiece when supported by said workpiece support, such that said first grinding assembly and said second grinding assembly may each individually grind different selected portions of a workpiece and such that said first grinding assembly and said second grinding assembly may simultaneously each grind other and different selected portions of a workpiece.

11. The grinding machine of claim 10, wherein said first grinding assembly and said second grinding assembly are each positionable and controllable to grind portions of a workpiece from one end of the workpiece to the other end of the workpiece.

12. The grinding machine of claim 10, wherein said workpiece support is also operable to rotate a workpiece, when supported thereby, according to workspeed parameters relating to surface regions of the workpiece when being ground and as effected by said grinding machine control.

13. The grinding machine of claim 12, wherein aid workspeed parameters take into consideration grinding of different surface regions of different portions of a workpiece which are to be ground.

14. The grinding machine of claim 10, wherein said first grinding assembly and said second grinding assembly are both disposed on the same side of said base with respect to said workpiece support.

15. The grinding machine of claim 14, wherein said first grinding assembly mounts a first grinding wheel of a size and configuration to grind two spaced selected portions of a workpiece and said second grinding assembly mounts a second grinding wheel of a size and configuration to grind two spaced selected portions of a workpiece.

16. The grinding machine of claim 10, wherein the portions of the workpiece to be ground are cams and the workpiece is a camshaft.

17. The grinding machine of claim 11 wherein said first grinding assembly and said second grinding assembly are so positionable longitudinally along axes of rotation parallel to an axis through the workpiece.

18. The grinding machine of claim 17 wherein said first grinding assembly and said grinding assembly are so controllable to move towards and away from a workpiece.

19. The method of grinding a workpiece; comprising:

(a) positioning a workpiece to be ground;

(b) rotating the workpiece about an axis of rotation extending through the workpiece;

(c) providing a first grinding means;

(d) providing a second grinding means;

(e) grinding first selected portions of the workpiece with said first grinding means;

(f) grinding second selected portions of the workpiece with said second grinding means;

(g) providing a control means to affect operation of said first grinding means and said second grinding means;

(h) said control means affecting operating of said first grinding means and said second grinding means so that, at a first selected interval in the grinding of a workpiece only said first grinding means is effective to grind and it grinds a first selected portion of the workpiece and so that a second selected interval in the grinding of a workpiece only said second grinding means is effective to grind and it grinds a second and different selected portion of the workpiece and further so that at other selected intervals in the grinding of a workpiece both said first grinding means and said second grinding means are each effective to grind still other different and selected portions of the workpiece and to do so simultaneously.

20. The means of grinding of claim 19, wherein the workpiece is a camshaft with individual cam portions each to be ground.

21. The method of grinding of claim 20, wherein said first grinding means is provided with a first grinding wheel having a pair of first grinding surfaces separated by a first predetermined space and said secured grinding means is provided with a second grinding wheel having a pair of second grinding surfaces separated by a second predetermined space.

22. A grinding machine, comprising:

(a) base means for supporting machine components;

(b) workpiece support means for supporting and positioning a workpiece and for rotating the workpiece about a workpiece axis of rotation extending through the workpiece;

(c) first grinding means carried by said base means for coaction with a workpiece, when supported by said workpiece support means, and mounting a first grinding wheel of a size and configuration to grind two space selected portions of a workpiece;

(d) second grinding means carried by said base means for coaction with a workpiece, when supported by said workpiece support means, and mounting a second grinding wheel of a size and configuration tog rind two spaced other selected portions of a workpiece that are spaced apart by a greater distance then the portions of the workpiece to be ground by said first grinding wheel;

(e) said first grinding means and said second grinding means being both disposed on the same side of said base means with respect to said workpiece support means; and (f) control means coacting with said first grinding means and said second grinding means to effect and control operation thereof and grinding of a workpiece, when supported by said workpiece support means, such that said first grinding means and said second grinding means may each individually grind selected portions of a workpiece and such that said first grinding means and said second grinding means may simultaneously each grind other selected portions of the workpiece.

23. A grinding machine, comprising:

(a) a grinding machine base;

(b) a workpiece support carried by said base;

(c) a first grinding assembly carried by said base and mounting a first grinding wheel of a size and configuration to grind two spaced selected portions of a workpiece;

(d) a second grinding assembly carried by said base and mounting a second grinding wheel of a size and configuration to rind two other spaced selected portions of a workpiece that are spaced apart by a greater distance then the portions of the workpiece to be ground by said first grinding wheel;

(e) said first grinding assembly and said second grinding assembly being both disposed on the same side of said grinding machine base with respect to said workpiece support;

(f) a grinding machine control coacting with said first grinding assembly and said second grinding assembly to effect and control operation thereof and grinding of a workpiece, when supported by said workpiece support, such that said first grinding assembly and said second grinding assembly may each individually grind selected portions of a workpiece and such that said first grinding assembly and said second grinding assembly may simultaneously each grind other selected portions of a workpiece.

24. The method of grinding a camshaft with individual cam portions, comprising:

(a) positioning a camshaft with individual cam portions each to be ground;

(b) rotating the camshaft about an axis of rotation extending through the camshaft;

(c) providing a first grinding means;

(d) providing said first grinding means with a first grinding wheel having a pair of first grinding surfaces seperated by a first predetermined space;

(e) providing a second grinding means;

(f) providing said second grinding means with a second grinding wheel having a pair of second grinding surfaces seperated by a second predetermined space greater in width then said first predetermined space;

(g) grinding first selected cam portions of the camshaft with said first grinding means; and (h) grinding second selected cam portions of the camshaft with said second grinding means;

(g) proividing a control means to effect operation of said first grinding means and said second grinding means;

(h) said control means effecting operation of said first grinding means and said second grinding means so that, at a first selected interval in the grinding of a a camshaft, only said first grinding means is effective to grind and it grinds first selected cam portions of the camshaft, and so that at a second selected interval in the grinding of a camshaft, only said second grinding means is effective to grind and it grinds second selected cam portions of the camshaft and further so that at other selected intervals in the grinding of a camshaft both said first grinding means and said second grinding means are each effective to grind different and selected cam portions of the camshaft and to do so simultaneously.

25. The method of grinding of claim 24, wherein the cams on the camshaft include multiple pairs of cams, each cam of the cams of each said pair of cams to be ground with identical phase angles and wherein selected ones of said cam pairs are spaced to correspond to said first predetermined space of said first grinding wheels first grinding surfaces and wherein alternate selected ones of said cam pairs are spaced to correspond to said second predetermined space of said second grinding wheel surfaces.

26. The method of grinding of claim 24, wherein said control means is effective to position and control said first grinding means and said second grinding means to provide for grinding the workpiece as follows:

(a) positioning and operating either said first grinding means or said second grinding means to grind a first cam pair;

(b) simultaneously positioning and operating said first grinding means and said second grinding means to respectively grind at least second and third cam pairs simultaneously; and (c) positioning and operating either said first grinding means or said second grinding means, whichever was not utilized to grind said first cam pair; to grind a final cam pair.

27. The method of grinding of claim 26, wherein said control means simultaneously positions said first grinding means and said second grinding means to simultaneously grind respective cam pairs multiple times after effective grinding of the first cam pair and prior to effecting grinding of the final cam pair.

28. The method of grinding of claim 27, wherein said control means controls the workspeed of rotation of said workpiece while cam pairs thereon are being ground to provide a workspeed for the workpiece related to the region of the cam surface then being ground.

29. The method of grinding of claim 28, wherein said control means so controls the workspeed when one cam pair has a different angle then that of another cam pair when both such cam pairs are being simultaneously ground so as to provide for maximum workspeeds not to exceed selected workspeeds for either of such cam pairs.

* * * * *